US011746545B1

(12) United States Patent
Lu et al.

(10) Patent No.: US 11,746,545 B1
(45) Date of Patent: Sep. 5, 2023

(54) METHOD FOR REINFORCING CONCRETE-FILLED STEEL TUBULAR COLUMN WITH OUTER CONCRETE-FILLED STEEL TUBE

(71) Applicant: WUHAN UNIVERSITY, Wuhan (CN)

(72) Inventors: Yiyan Lu, Wuhan (CN); Shan Li, Wuhan (CN); Zhenzhen Liu, Wuhan (CN); Yuhong Yan, Wuhan (CN); Weijie Li, Wuhan (CN)

(73) Assignee: WUHAN UNIVERSITY, Wuhan (CN)

( * ) Notice: Subject to any disclaimer, the term of this patent is extended or adjusted under 35 U.S.C. 154(b) by 0 days.

(21) Appl. No.: 18/097,808

(22) Filed: Jan. 17, 2023

(30) Foreign Application Priority Data

Apr. 29, 2022 (CN) ..... 202210475506.2

(51) Int. Cl.

| | |
|---|---|
| ***E04G 23/02*** | (2006.01) |
| ***B24B 5/22*** | (2006.01) |
| ***B24B 41/04*** | (2006.01) |
| ***B24B 47/12*** | (2006.01) |

(52) U.S. Cl.
CPC ..... *E04G 23/0218* (2013.01); *B24B 5/22* (2013.01); *B24B 41/04* (2013.01); *B24B 47/12* (2013.01)

(58) Field of Classification Search
CPC ..... E04G 23/0225; E04G 13/00; E04G 13/02; E04G 13/021; E04G 13/028; E04G 23/0218; E04H 12/2292; E02D 5/60; E02D 5/64; E02D 37/00; B24B 5/22; B24B 41/04; B24B 47/12; B24B 27/033; B24B 5/04; B24B 41/00; B24B 9/007
See application file for complete search history.

(56) References Cited

U.S. PATENT DOCUMENTS 4,543,764 A * 10/1985 Kozikowski ..... E04G 23/0218 52/309.3
5,136,969 A * 8/1992 Chapman ..... F16L 55/168 118/305
5,199,226 A * 4/1993 Rose ..... B24C 3/32 118/313
5,458,683 A * 10/1995 Taylor ..... B08B 9/023 134/122 R (Continued)

FOREIGN PATENT DOCUMENTS

AU 2021102442 A4 * 6/2021
CN 105643412 A * 6/2016

(Continued)

*Primary Examiner* — Theodore V Adamos

(74) *Attorney, Agent, or Firm* — Stuart H. Mayer; Mayer & Williams PC

(57) ABSTRACT

Disclosed are a method and equipment for reinforcing a concrete-filled steel tubular column with an outer concrete-filled steel tube. The method includes following steps: step 1, grinding and derusting an outer wall of a concrete-filled steel tubular column to be reinforced by an auxiliary device; step 2, welding two prefabricated semi-rectangular steel plates in advance, forming a complete rectangular steel tube with the two semi-rectangular steel plates and sleeving the rectangular steel tube outside the concrete-filled steel tubular column to be reinforced; and step 3, filling self-compacting concrete between the outer wall of the concrete-filled steel tubular column to be reinforced and an inner wall of the rectangular steel tube to complete a reinforcement.

4 Claims, 6 Drawing Sheets

(56) References Cited

U.S. PATENT DOCUMENTS

| | | | | | |
|---|---|---|---|---|---|
| 6,006,488 | A * | 12/1999 | Okitomo | E04G 23/0218 52/834 |
| 6,219,988 | B1 * | 4/2001 | Mahfouz | E04G 23/0218 52/834 |
| 10,208,493 | B1 * | 2/2019 | Sim | E04C 5/0622 |
| 2008/0155827 | A1 * | 7/2008 | Fyfe | E04G 23/0218 29/897.1 |
| 2017/0218591 | A1 * | 8/2017 | Kriegstein | E04H 12/2292 |
| 2021/0131126 | A1 * | 5/2021 | Zhuang | B24B 47/12 |

FOREIGN PATENT DOCUMENTS

| | | | | |
|---|---|---|---|---|
| CN | 106677551 | A | 5/2017 | |
| CN | 207656443 | U | 7/2018 | |
| CN | 108500806 | A * | 9/2018 | B24B 27/033 |
| CN | 110565975 | A | 12/2019 | |
| CN | 110666663 | A | 1/2020 | |
| CN | 113118948 | A | 7/2021 | |
| WO | 2022077656 | A1 | 4/2022 | |

* cited by examiner

METHOD FOR REINFORCING CONCRETE-FILLED STEEL TUBULAR COLUMN WITH OUTER CONCRETE-FILLED STEEL TUBE

CROSS-REFERENCE TO RELATED APPLICATIONS

This application claims priority to Chinese Patent Application No. 202210475506.2, filed on Apr. 29, 2022, the contents of which are hereby incorporated by reference.

TECHNICAL FIELD

The application relates to the technical field of building reconstruction, and in particular to a method for reinforcing a concrete-filled steel tubular column with an outer concrete-filled steel tube.

BACKGROUND

At present, concrete-filled steel tubular columns are used as load-bearing members in construction projects. Because steel tubes may act together with concrete, working conditions of the steel tubes and the concrete under compression may be improved. For each steel tube, a stability of a tube wall under compression is improved to some extent since the tube is filled with the concrete. For the core concrete, in a compression process, due to a constraint of the steel tube wall, the core concrete is in a state of three-dimensional stress, so a strength of the concrete is greatly improved. Therefore, a compressive bearing capacity of the whole concrete-filled steel tubular column is 1.5-2.5 times larger than that of the steel tube and the concrete under compression respectively.

The concrete-filled steel tubular columns have advantages of a high bearing capacity, a good seismic performance and convenient construction, and are increasingly widely used in high-rise buildings and piers of long-span bridges. However, due to influences of functional changes, natural disasters, improper design or construction and other factors, it is urgent to take reinforcement measures on some structures to greatly improve the bearing capacity and stiffness of the structures.

Common reinforcement methods are an externally bonded fibre reinforced polymer reinforcement method and an enlarged section reinforcement method. However, it is difficult to greatly improve the bearing capacity and stiffness of the members with the externally bonded FRP reinforcement. The enlarged section reinforcement method requires formwork support, formwork removal and steel bar binding, and construction steps are complicated.

Therefore, there is an urgent need for a method for reinforcing a concrete-filled steel tubular column with an outer concrete-filled steel tube to solve the above problems.

SUMMARY

An objective of the application is to provide a method for reinforcing a concrete-filled steel tubular column with an outer concrete-filled steel tube, so as to solve the problems existing in the prior art.

In order to achieve the above objective, the application provides a following scheme: the application provides the method for reinforcing the concrete-filled steel tubular column with the outer concrete-filled steel tube, including following steps:

step 1, grinding and derusting an outer wall of a concrete-filled steel tubular column to be reinforced by an auxiliary device;

step 2, welding two prefabricated semi-rectangular steel plates in advance, forming a complete rectangular steel tube with the two semi-rectangular steel plates and sleeving the rectangular steel tube outside the concrete-filled steel tubular column to be reinforced; and step 3, filling self-compacting concrete between the outer wall of the concrete-filled steel tubular column to be reinforced and an inner wall of the rectangular steel tube to complete a reinforcement.

In an embodiment, in the step 2, four positioning steel bars are welded at equal intervals on the outer wall of the concrete-filled steel tubular column to be reinforced before welding the two semi-rectangular steel plates, and two oppositely arranged positioning steel bars are respectively abutted against middles of the two semi-rectangular steel plates, and the other two oppositely arranged positioning steel bars are respectively abutted against edges of the two semi-rectangular steel plates, realizing butt joint after positioning the two semi-rectangular steel plates.

In an embodiment, a circumferential direction of the concrete-filled steel tubular column to be reinforced set in the step 2 coincides with a center line of the rectangular steel tube.

In an embodiment, in the step 3, a bottom of the rectangular steel tube is provided with a slurry inlet hole, and a top of the rectangular steel tube is provided with a slurry outlet hole; the self-compacting concrete is introduced into the rectangular steel tube through the slurry inlet hole until the self-compacting concrete flows out of the slurry outlet hole, and then the slurry inlet hole and the slurry outlet hole are welded to complete the reinforcement.

The auxiliary device includes a bottom plate, and a side of the bottom plate is provided with a limiting groove, and the limiting groove is matched with the concrete-filled steel tubular column to be reinforced; a top of the bottom plate is provided with a lifting mechanism, a top of the lifting mechanism is in transmission connection with a lifting plate, and a shape of the lifting plate is matched with that of the bottom plate; a rotating mechanism is arranged in the lifting plate, and one side of a top surface of the lifting plate is provided with a driving mechanism, and the driving mechanism is in transmission connection with the rotating mechanism; and a top of the rotating mechanism is provided with two corresponding clamping mechanisms, and tops of the clamping mechanisms are provided with grinding mechanisms.

In an embodiment, the lifting mechanism includes two lifting motors, and the two lifting motors are fixedly connected to both sides of a top surface of the bottom plate; output ends of the lifting motors are fixedly connected with lifting screws, tops of the lifting screws penetrate through the lifting plate; the top surface of the lifting plate is respectively provided with two threaded holes and two guide holes, the two guide holes are symmetrically arranged about a center line of the lifting plate, and the two threaded holes are symmetrically arranged about the center line of the lifting plate, and outer walls of the lifting screws are connected with inner walls of the threaded holes through threads; and two sides of the top surface of the bottom plate are respectively fixedly connected with guide posts, tops of the two guide posts respectively penetrate through the two guide posts, and outer walls of the guide posts are in sliding contact with inner walls of the guide holes.

In an embodiment, the rotating mechanism includes an arc-shaped rod, and two opposite inner walls of the lifting plate are respectively provided with arc-shaped grooves matched with the arc-shaped rod; two ends of the arc-shaped rod are respectively in sliding contact with inner walls of the two arc-shaped grooves, and an outer wall of the arc-shaped rod is in transmission connection with the driving mechanism.

In an embodiment, the driving mechanism includes a driving motor, and the driving motor is fixedly connected to the top surface of the lifting plate; an output end of the driving motor is fixedly connected with a rotating disc, and an edge of a top surface of the rotating disc is fixedly connected with a rotating rod; a top outer wall of the rotating rod is rotatably connected with one end of a transmission rod through a bearing, and the other end of the transmission rod is provided with a transmission hole; an inner wall of the transmission hole is rotatably connected with one end of a hinge rod through a bearing, the outer wall of the arc-shaped rod is fixedly connected with a hinge seat, and the hinge rod is hinged with the hinge seat.

In an embodiment, each clamping mechanism includes a lifting cylinder, and the lifting cylinder is fixedly connected to one end of a top surface of the arc-shaped rod; an output end of the lifting cylinder is fixedly connected with a lifting rod, and a top surface of the lifting rod is fixedly connected with one end of a clamping plate, and a top surface of the other end of the clamping plate is fixedly connected with a clamping seat; a side surface of the clamping seat is fixedly connected with a butt joint cylinder; an output end of the butt joint cylinder passes through the clamping seat and is fixedly connected with one end of a butt joint rod, and the other end of the butt joint rod is fixedly connected with one end of the displacement rod; and a bottom surface of the displacement rod is in sliding contact with a top surface of the clamping plate, and the other end of the displacement rod is fixedly connected with each grinding mechanism.

In an embodiment, each grinding mechanism includes a semi-circular ring, and a top of the semi-circular ring is provided with an air blowing assembly; a top surface of the semi-circular ring is fixedly connected with a vibration motor, and an inner wall of the semi-circular ring is provided with a plurality of grinding assemblies at equal intervals, and a circumferential direction of the plurality of grinding assemblies coincides with a radius direction of the semi-circular ring;

each air blowing assembly includes an air pump, and the air pump is fixedly connected to the top surface of the semi-circular ring, an output end of the air pump is communicated with one end of an air blowing pipe, the other end of the air blowing pipe is communicated with a nozzle, and an input end of the air pump is communicated with an outside atmosphere; and each grinding assembly includes a shell, and the shell is fixedly connected to the outer wall of the semi-circular ring, and a grinding cylinder is fixedly connected to a side of the shell; an output end of the grinding cylinder penetrates through the shell and is fixedly connected to one end of a telescopic cylinder, the other end of the telescopic cylinder penetrates through the outer wall of the semi-circular ring, and a grinding motor is fixedly connected to an inner wall of the telescopic cylinder; an output end of the grinding motor is fixedly connected to one end of a grinding rod, and the other end of the grinding rod is fixedly connected with a grinding disc, and a sandpaper is detachably connected to a side of the grinding disc.

The application discloses following technical effect. The application solves the problems that an original circular concrete-filled steel tubular column may not meet functional requirements, and a bearing capacity and rigidity of a member need to be greatly improved under a condition that a section shape of the member is unchanged; and the application greatly improves the bearing capacity and rigidity of the original circular concrete-filled steel tubular column without changing the section shape, and has convenient construction and remarkable economic benefits. A bottom surface of the bottom plate is provided with a plurality of pulleys, thus realizing a movement of the whole device, enhancing a maneuverability, making the device flexibly adjusted at a construction site, and meanwhile making the whole device more efficient in an adjustment process for aligning with an axis of the concrete-filled steel tubular column to be reinforced. The size of the limiting groove is larger than that of the concrete-filled steel tubular column to be reinforced, so that the concrete-filled steel tubular column to be reinforced may be located in the limiting groove, and processing and derusting for the outer wall of the concrete-filled steel tubular column to be reinforced are facilitated. The arranged lifting mechanism may realize an all-round cleaning of the whole outer wall of the concrete-filled steel tubular column to be reinforced from top to bottom, avoid a dead angle on the concrete-filled steel tubular column to be reinforced, enhance a connection between the concrete-filled steel tubular column to be reinforced and the self-compacting concrete, and enhance an overall connection strength. The arranged rotating mechanism may rotate in a reciprocating small range, and cooperate with the arranged grinding mechanisms to grind and derust the outer wall of the concrete-filled steel tubular column to be reinforced along. The driving mechanism may drive the rotating mechanism to rotate in a reciprocating manner, and the clamping mechanisms are in a separated state when the clamping mechanisms are not in positioning contact with the concrete-filled steel tubular column to be reinforced. When the concrete-filled steel tubular column to be reinforced is ground, the concrete-filled steel tubular column to be reinforced and the clamping mechanisms are close to each other to grind the concrete-filled steel tubular column to be reinforced. The grinding mechanisms cooperate with the lifting mechanism, and the grinding mechanisms cooperate with the clamping mechanisms to realize a secondary lifting, thus increasing a grinding range and further improving a wide adaptability. According to the application, the self-compacting concrete may be used to fill a template space by itself without vibrating, so as to form uniform and compact concrete of concrete members. The concrete is especially suitable for concrete projects with a large pouring amount, a deep pouring depth or a high pouring height, dense steel bars and special shapes that may not be vibrated. In a construction process, the self-compacting concrete does not need to be vibrated, thus reducing construction noises, easing a contradiction of disturbing people, simplifying the process, shorten a construction period and improving an efficiency. On the other hand, the self-compacting concrete makes great use of industrial wastes such as fly ash and slag powder, which is beneficial to environmental protection. The concrete is suitable for concrete pouring of all kinds of buildings, especially for grouting and pouring with the large pouring amount, the deep pouring depth or the high pouring height and the dense steel bars for large complicated special-shaped structures with special shapes and inconvenient vibration, steel reinforced concrete and equipment foundations. Meanwhile, a vibration process after using ordinary concrete and a structural damage are avoided.

BRIEF DESCRIPTION OF THE DRAWINGS

In order to more clearly explain embodiments of the application or technical solutions in the prior art, the following may briefly introduce drawings that need to be used in the embodiments. Obviously, the drawings in the following description are only some embodiments of the application. For those of ordinary skill in the art, other drawings may be obtained according to these drawings without any creative effort.

DETAILED DESCRIPTION OF THE EMBODIMENTS

Figure 1:
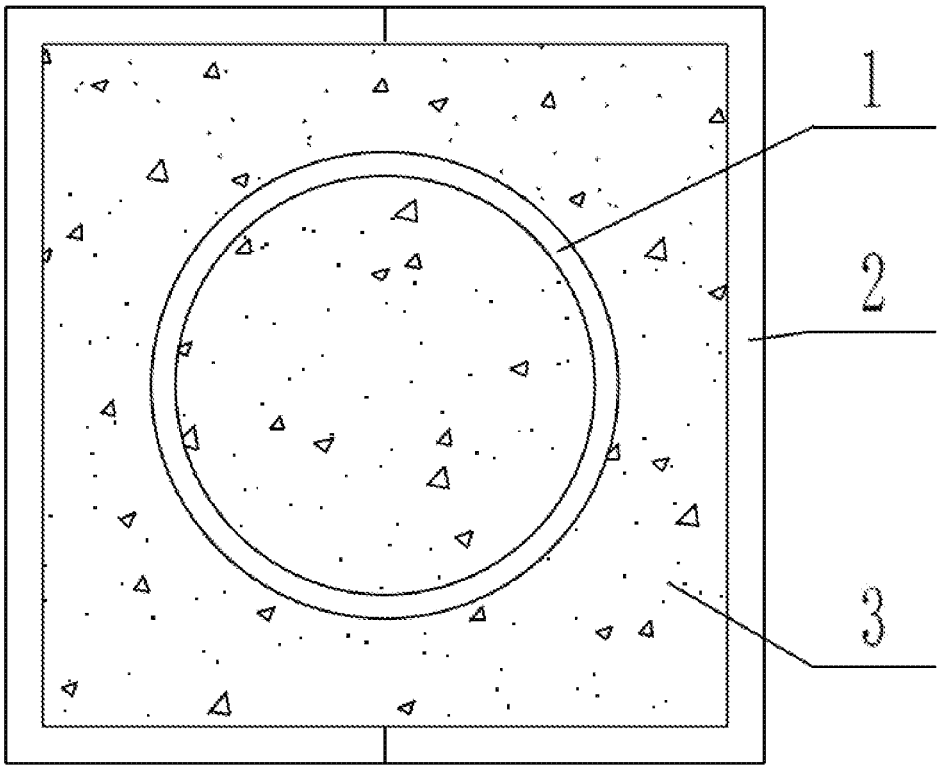
FIG. 1 is a structural schematic diagram of a concrete-filled steel tubular column reinforced with an outer concrete-filled steel tube.
Figure 2:
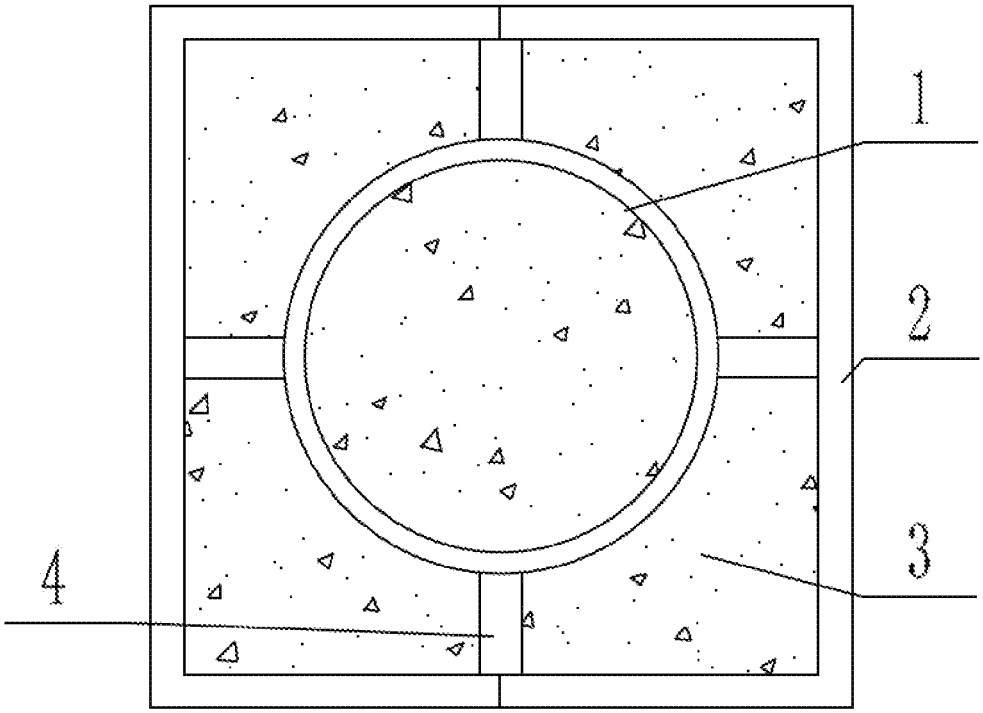
FIG. 2 is a structural diagram of positioning steel bars according to the application.
Figure 3:
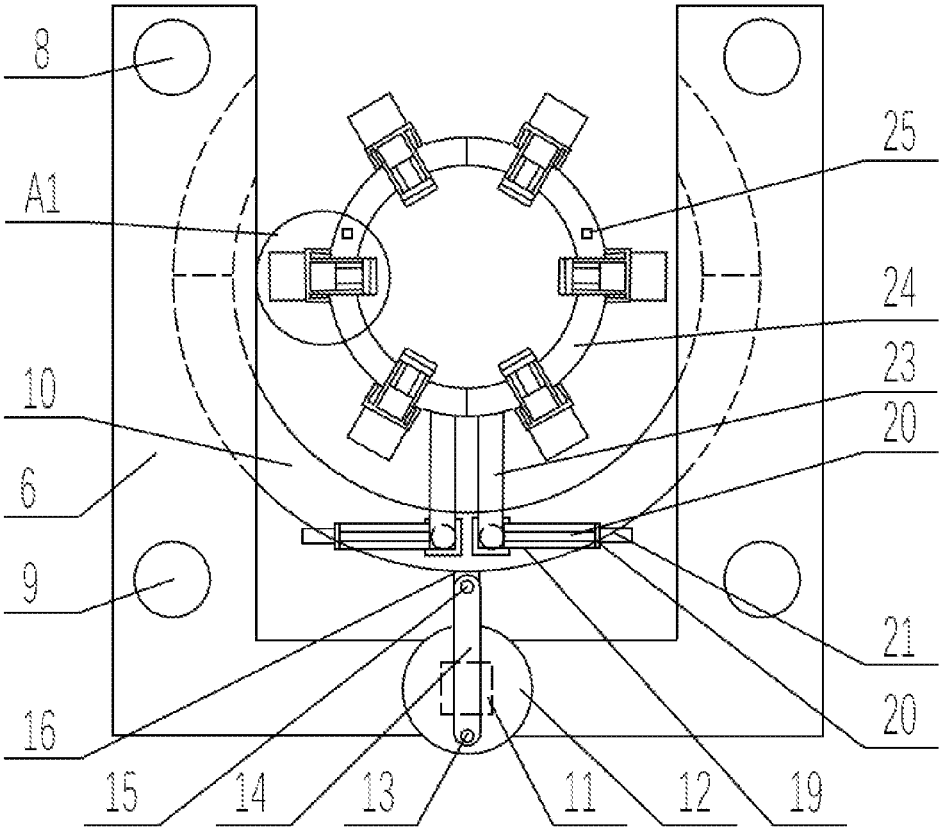
FIG. 3 is a schematic structural diagram of an auxiliary device according to the application.
Figure 4:
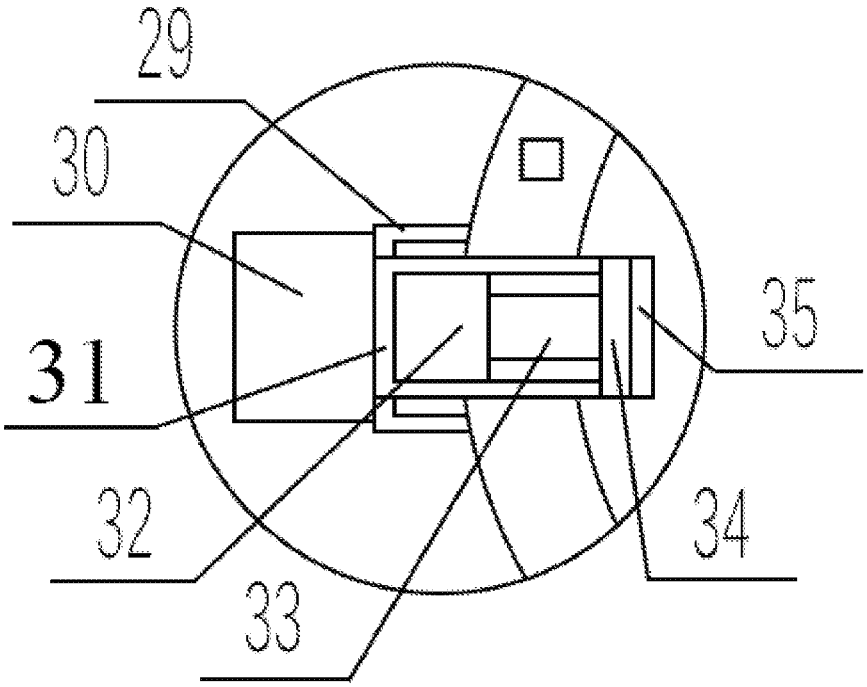
FIG. 4 is a partial enlarged view of A1 in FIG. 3.
Figure 5:
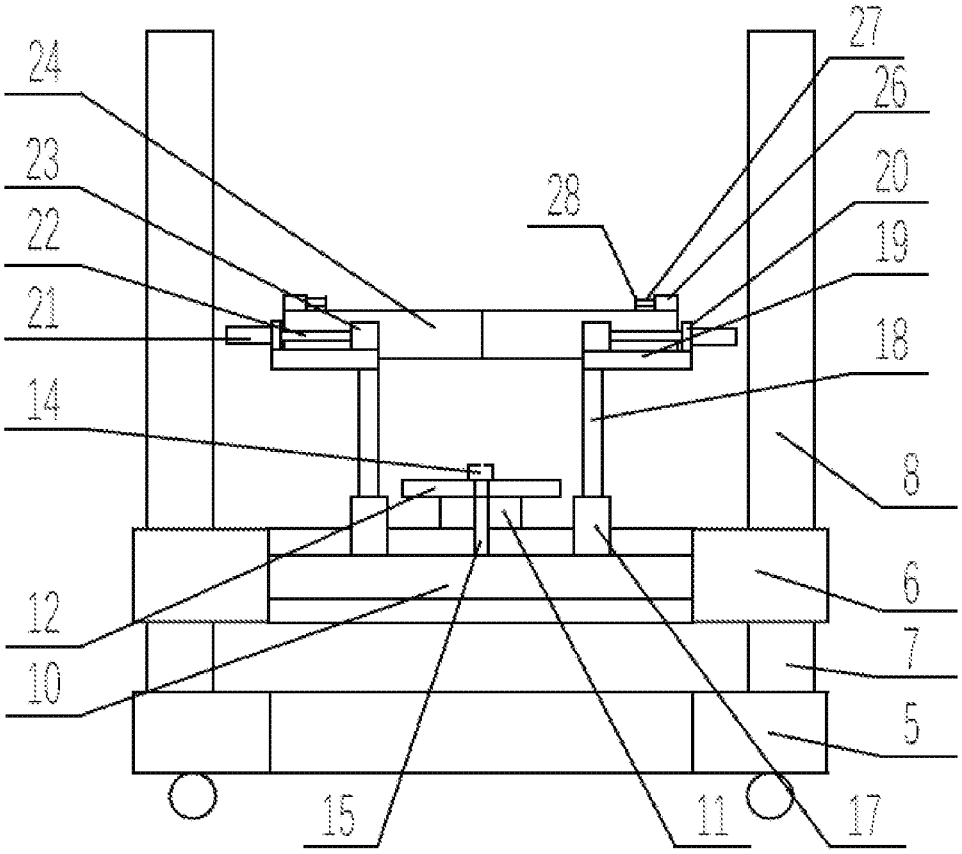
FIG. 5 is a front view of an auxiliary device according to the application.

Technical solutions in embodiments of the application may be clearly and completely described below with reference to drawings in the embodiments of the application. Obviously, the described embodiments are only part of the embodiments of the application, but not all of them. Based on the embodiment of the application, all other embodiments obtained by ordinary technicians in a field without creative labor are within a scope of the application.

In order to make the above objects, features and advantages of the application more obvious and understandable, the application may be explained in further detail below with reference to the drawings and detailed description.

With reference to FIGS. 1-5, the application provides a method for reinforcing a concrete-filled steel tubular column with an outer concrete-filled steel tube, including following steps:

step 1, grinding and derusting an outer wall of a concrete-filled steel tubular column 1 to be reinforced by an auxiliary device;

step 2, welding two prefabricated semi-rectangular steel plates 2 in advance, forming a complete rectangular steel tube with the two semi-rectangular steel plates 2 and sleeving the rectangular steel tube outside the concrete-filled steel tubular column 1 to be reinforced; and step 3, filling self-compacting concrete 3 between the outer wall of the concrete-filled steel tubular column 1 to be reinforced and an inner wall of the rectangular steel tube to complete a reinforcement.

The application solves problems that an original circular concrete-filled steel tubular column may not meet functional requirements, and a bearing capacity and rigidity of a member need to be greatly improved under a condition that a section shape of the member is unchanged; and the application greatly improves the bearing capacity and rigidity of the original circular concrete-filled steel tubular column without changing the section shape, and has convenient construction and remarkable economic benefits.

In an embodiment, in the step 2, four positioning steel bars 4 are welded at equal intervals on the outer wall of the concrete-filled steel tubular column 1 to be reinforced before welding the two semi-rectangular steel plates 2, and two oppositely arranged positioning steel bars 4 are respectively abutted against middles of the two semi-rectangular steel plates 2, and the other two oppositely arranged positioning steel bars 4 are respectively abutted against edges of the two semi-rectangular steel plates 2, so as to realize butt joint after positioning the two semi-rectangular steel plates 2.

The positioning steel bars 4 may position the two semi-rectangular steel plates 2. Since an inner cavity of a rectangular steel plate formed by the butt joint of the two semi-rectangular steel plates 2 has a rectangular structure, and the concrete-filled steel tubular column 1 to be reinforced has a cylindrical structure, there is a gap between the inner cavity and the concrete-filled steel tubular column 1 to be reinforced. This gap is used for pouring the self-compacting concrete 3 to realize the reinforcement of the concrete-filled steel tubular column 1 to be reinforced. In order to enable the self-compacting concrete 3 to be evenly filled around the outer wall of the concrete-filled steel tubular column 1 to be reinforced in the gap, the rectangular steel tube and the concrete-filled steel tubular column 1 to be reinforced need to be concentrically arranged. End faces of the positioning steel plates are butted with the inner walls and the edges of the semi-rectangular steel plates 2, so that the rectangular steel tube and the concrete-filled steel tubular column 1 to be reinforced may be concentrically arranged, a uniformity of the self-compacting concrete 3 filling between the rectangular steel tube and the concrete-filled steel tubular column 1 to be reinforced is ensured, and a reinforcement degree is further enhanced. Meanwhile, the positioning steel plates may realize synchronous welding of the positioning steel plates at weld seams during the welding of the two semi-rectangular steel plates; the welding of one semi-rectangular steel plate 2 with two corresponding positioning steel plates is completed first, and then the welding of the other semi-rectangular steel plate 2 is completed, thus further improving a work efficiency. According to the application, the self-compacting concrete 3 may be used to fill a template space by itself without vibrating, so as to form uniform and compact concrete of concrete members. The concrete is especially suitable for concrete projects with a large pouring amount, a deep pouring depth or a high pouring height, dense steel bars and special shapes that may not be vibrated. In a construction process, the self-compacting concrete 3 does not need to be vibrated, thus reducing construction noises, easing a contradiction of disturbing people, simplifying the process, shorten a construction period and improving an efficiency. On the other hand, the self-compacting concrete 3 makes great use of industrial wastes such as fly ash and slag powder, which is beneficial to environmental protection. The concrete is suitable for concrete pouring of all kinds of buildings, especially for grouting and pouring with the large pouring amount, the deep pouring depth or the high pouring height and the dense steel bars for large complicated special-shaped structures with special shapes and inconvenient vibration, steel reinforced concrete and equipment foundations. Meanwhile, a vibration process after using ordinary concrete and a structural damage are avoided.

In an embodiment, a circumferential direction of the concrete-filled steel tubular column 1 to be reinforced set in the step 2 coincides with a center line of the rectangular steel tube.

In an embodiment, in the step 3, a bottom of the rectangular steel tube is provided with a slurry inlet hole, and a top of the rectangular steel tube is provided with a slurry outlet hole. The self-compacting concrete 3 is introduced into the rectangular steel tube through the slurry inlet hole until the self-compacting concrete 3 flows out of the slurry outlet hole, and then the slurry inlet hole and the slurry outlet hole are welded to complete the reinforcement.

Filling the self-compacting concrete 3 from the bottom to the top may make the filling of the self-compacting concrete 3 more uniform and ensure an internal uniformity. At the same time, after the internal filling is completed, the self-compacting concrete 3 may be discharged from the slurry outlet hole, and the self-compacting concrete 3 is filled, so that an internal filling situation may be judged in time to avoid incomplete filling or slurry waste.

The auxiliary device includes a bottom plate 5, a side of the bottom plate 5 is provided with a limiting groove, and the limiting groove is matched with the concrete-filled steel tubular column 1 to be reinforced; a top of the bottom plate 5 is provided with a lifting mechanism, a top of the lifting mechanism is in transmission connection with a lifting plate 6, and a shape of the lifting plate 6 is matched with that of the bottom plate 5; a rotating mechanism is arranged in the lifting plate 6, and one side of a top surface of the lifting plate 6 is provided with a driving mechanism, and the driving mechanism is in transmission connection with the rotating mechanism; and a top of the rotating mechanism is provided with two corresponding clamping mechanisms, and tops of the clamping mechanisms are provided with grinding mechanisms.

A bottom surface of the bottom plate 5 is provided with a plurality of pulleys, thus realizing a movement of the whole device, enhancing a maneuverability, making the device flexibly adjusted at a construction site, and meanwhile making the whole device more efficient in an adjustment process for aligning with an axis of the concrete-filled steel tubular column 1 to be reinforced. The size of the limiting groove is larger than that of the concrete-filled steel tubular column 1 to be reinforced, so that the concrete-filled steel tubular column 1 to be reinforced may be located in the limiting groove, and processing and derusting for the outer wall of the concrete-filled steel tubular column 1 to be reinforced are facilitated. The arranged lifting mechanism may realize an all-round cleaning of the whole outer wall of the concrete-filled steel tubular column 1 to be reinforced from top to bottom, avoid a dead angle on the concrete-filled steel tubular column 1 to be reinforced, enhance a connection between the concrete-filled steel tubular column 1 to be reinforced and the self-compacting concrete 3, and enhance an overall connection strength. The arranged rotating mechanism may rotate in a reciprocating small range, and cooperate with the arranged grinding mechanisms to grind and derust the outer wall of the concrete-filled steel tubular column 1 to be reinforced along. The driving mechanism may drive the rotating mechanism to rotate in a reciprocating manner, and the clamping mechanisms are in a separated state when the clamping mechanisms are not in positioning contact with the concrete-filled steel tubular column 1 to be reinforced. When the concrete-filled steel tubular column 1 to be reinforced is ground, the concrete-filled steel tubular column 1 to be reinforced and the clamping mechanisms are close to each other to grind the concrete-filled steel tubular column 1 to be reinforced. The grinding mechanisms cooperate with the lifting mechanism, and the grinding mechanisms cooperate with the clamping mechanisms to realize a secondary lifting, thus increasing a grinding range and further improving a wide adaptability.

In an embodiment, the lifting mechanism includes two lifting motors 7, and the two lifting motors 7 are fixedly connected to both sides of a top surface of the bottom plate 5; output ends of the lifting motors 7 are fixedly connected with lifting screws 8, tops of the lifting screws 8 penetrate through the lifting plate 6; a top surface of the lifting plate 6 is respectively provided with two threaded holes and two guide holes, the two guide holes are symmetrically arranged about a center line of the lifting plate 6, and the two threaded holes are symmetrically arranged about the center line of the lifting plate 6, and outer walls of the lifting screws 8 are connected with inner walls of the threaded holes through threads; and two sides of the top surface of the bottom plate 5 are respectively fixedly connected with guide posts 9, tops of the two guide posts 9 respectively penetrate through the two guide posts 9, and outer walls of the guide posts 9 are in sliding contact with inner walls of the guide holes.

The lifting motors 7 may drive the lifting screws 8 to rotate, the threaded holes are arranged to cooperate with the lifting screws 8, and then a lifting effect is realized through a guiding effect of the guide posts 9. An arrangement of the plurality of lifting screws 8 and the guide posts 9 may make a lifting process of the lifting plate 6 more stable. The lifting mechanism may realize the all-round cleaning of the whole outer wall of the concrete-filled steel tubular column 1 to be reinforced from top to bottom, avoid the dead angle on the concrete-filled steel tubular column 1 to be reinforced, enhance the connection between the concrete-filled steel tubular column 1 to be reinforced and the self-compacting concrete 3, and enhance the overall connection strength.

In an embodiment, the rotating mechanism includes an arc-shaped rod 10, and two opposite inner walls of the lifting plate 6 are respectively provided with arc-shaped grooves matched with the arc-shaped rod 10; two ends of the arc-shaped rod 10 are respectively in sliding contact with inner walls of the two arc-shaped grooves, and an outer wall of the arc-shaped rod 10 is in transmission connection with the driving mechanism.

The arc-shaped rod 10 may be driven by the driving mechanism to move, thus driving the grinding mechanisms to derust the outer wall of the concrete-filled steel tubular column 1 to be reinforced.

In an embodiment, the driving mechanism includes a driving motor 11, and the driving motor 11 is fixedly connected to the top surface of the lifting plate 6; an output end of the driving motor 11 is fixedly connected with a rotating disc 12, and an edge of a top surface of the rotating disc 12 is fixedly connected with a rotating rod 13; a top outer wall of the rotating rod 13 is rotatably connected with one end of a transmission rod 14 through a bearing, and the other end of the transmission rod 14 is provided with a transmission hole; an inner wall of the transmission hole is rotatably connected with one end of a hinge rod 15 through a bearing, the outer wall of the arc-shaped rod 10 is fixedly connected with a hinge seat 16, and the hinge rod 15 is hinged with the hinge seat 16.

The rotating rod 13 is fixedly connected to a top edge of the rotating disc 12, the top outer wall of the rotating rod 13 is rotatably connected with one end of the transmission rod 14 through the bearing, and the inner wall of the transmission hole is rotatably connected with one end of the hinge rod 15 through the bearing, and the outer wall of the arc-shaped rod 10 is fixedly connected with the hinge seat 16, and the hinge rod 15 is hinged with the hinge seat 16, so that when the driving motor 11 operates, the arc-shaped rod 10 may rotate back and forth, and the derusting of the outer wall of the concrete-filled steel tubular column 1 to be reinforced by the grinding mechanisms is realized.

In an embodiment, each clamping mechanism includes a lifting cylinder 17, and the lifting cylinder 17 is fixedly connected to one end of a top surface of the arc-shaped rod 10; an output end of the lifting cylinder 17 is fixedly connected with a lifting rod 18, and a top surface of the lifting rod 18 is fixedly connected with one end of a clamping plate 19, and a top surface of the other end of the clamping plate 19 is fixedly connected with a clamping seat 20; a side surface of the clamping seat 20 is fixedly connected with a butt joint cylinder 21; an output end of the butt joint cylinder 21 passes through the clamping seat 20 and is fixedly connected with one end of a butt joint rod 22, and the other end of the butt joint rod 22 is fixedly connected with one end of the displacement rod 23; and a bottom surface of the displacement rod 23 is in sliding contact with a top surface of the clamping plate 19, and the other end of the displacement rod 23 is fixedly connected with each grinding mechanism.

The lifting cylinders 17 may drive the lifting rods 18 to move up and down, thus driving the grinding mechanisms to clean the whole outer wall of the concrete-filled steel tubular column 1 from top to bottom, avoiding the dead angle of the concrete-filled steel tubular column 1 to be reinforced, enhancing the connection between the concrete-filled steel tubular column 1 to be reinforced and the self-compacting concrete 3, and enhancing the overall connection strength. The grinding mechanisms may clamp and abut to the concrete-filled steel tubular column 1 to be reinforced with the clamping cylinders, so the outer wall of the concrete-filled steel tubular column 1 to be reinforced is processed.

In an embodiment, each grinding mechanism includes a semi-circular ring 24; a top of the semi-circular ring 24 is provided with an air blowing assembly, and a top surface of the semi-circular ring 24 is fixedly connected with a vibration motor 25, and an inner wall of the semi-circular ring 24 is provided with a plurality of grinding assemblies at equal intervals, and a circumferential direction of the plurality of grinding assemblies coincides with a radius direction of the semi-circular ring 24; and each vibration motor 25 may vibrate while grinding and cleaning the concrete-filled steel tubular column 1 to be reinforced, avoid residue of rust on the concrete-filled steel tubular column 1 to be reinforced, and shake off the rust attached to the concrete-filled steel tubular column 1 to be reinforced.

each air blowing assembly includes an air pump 26, and the air pump 26 is fixedly connected to the top surface of the semi-circular ring 24, an output end of the air pump 26 is communicated with one end of an air blowing pipe 27, the other end of the air blowing pipe 27 is communicated with a nozzle 28, and an input end of the air pump 26 is communicated with an outside atmosphere; the air pump 26 may blow a sandpaper 35 to clean the outer wall of the concrete-filled steel tubular column 1 to be reinforced, and blow off the rust.

Each grinding assembly includes a shell 29, and the shell 29 is fixedly connected to the outer wall of the semi-circular ring 24, and a grinding cylinder 30 is fixedly connected to a side of the shell 29; an output end of the grinding cylinder 30 penetrates through the shell 29 and is fixedly connected to one end of a telescopic cylinder 31, the other end of the telescopic cylinder 31 penetrates through the outer wall of the semi-circular ring 24, and a grinding motor 32 is fixedly connected to an inner wall of the telescopic cylinder 31; an output end of the grinding motor 32 is fixedly connected to one end of a grinding rod 33, and the other end of the grinding rod 33 is fixedly connected with a grinding disc 34, and the sandpaper 35 is detachably connected to a side of the grinding disc 34.

Each grinding cylinder 30 may push out each telescopic cylinder 31, and an axial direction of each grinding cylinder 30 coincides with a radial direction of the concrete-filled steel tubular column 1 to be reinforced, so that an adaptability may be enhanced for various concrete-filled steel tubular columns 1 to be reinforced with different diameters, and each grinding motor 32 may drive each sandpaper 35 to abut against the outer wall of the concrete-filled steel tubular column 1 and rotate at the same time, thus further improving a grinding efficiency.

Figure 6:
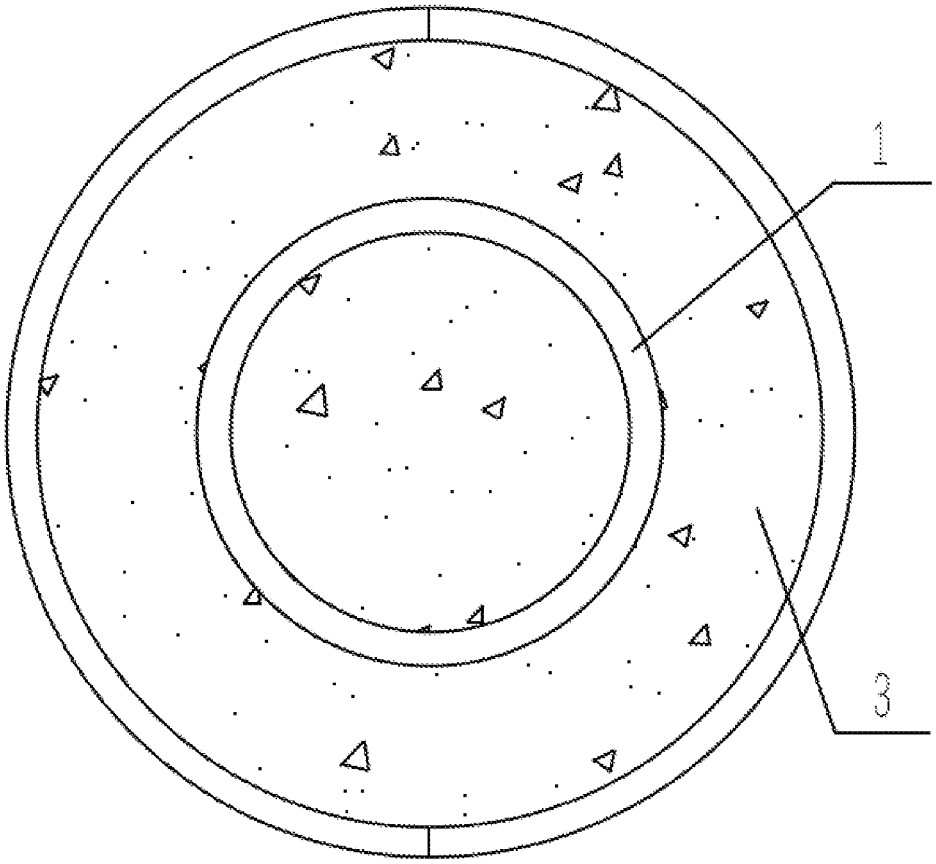
FIG. 6 is a structural diagram of an embodiment of the application.

With reference to FIG. 6, in one embodiment of the application, the two semi-rectangular steel plates 2 may be replaced by two semi-circular steel plates, and the two semi-circular steel plates may form a whole circle, so that the rectangular concrete-filled steel tubular column is reinforced with a circular steel tube.

In the description of the application, it should be understood that terms "longitudinal", "transverse", "up", "down", "front", "back", "left", "right", "vertical", "horizontal", "top", "bottom", "inside", "outside" and other directions or positional relationships indicated are based on the directions or positional relationships shown in drawings, only for convenience of describing the application, rather than indicating or implying that the device or element referred to must have a specific orientation, be constructed and operated in a specific orientation. Therefore, the terms cannot be understood as a limitation of the application.

The above-mentioned embodiments only describe the preferred mode of the application, but do not limit the scope of the application. On a premise of not departing from a design spirit of the application, all kinds of modifications and improvements made by ordinary technicians in the field to the technical scheme of the application shall fall within the scope of protection determined by claims of the application.

What is claimed is:

1. A method for reinforcing a concrete-filled steel tubular column with an outer concrete-filled steel tube, comprising:

step 1, grinding and derusting an outer wall of a concrete-filled steel tubular column to be reinforced by an auxiliary device;

step 2, welding two prefabricated semi-rectangular steel plates in advance, forming a complete rectangular steel tube with the two semi-rectangular steel plates and sleeving the rectangular steel tube outside the concrete-filled steel tubular column to be reinforced; and step 3, filling self-compacting concrete between the outer wall of the concrete-filled steel tubular column to be reinforced and an inner wall of the rectangular steel tube to complete a reinforcement;

wherein the auxiliary device comprises a bottom plate, a side of the bottom plate is provided with a limiting groove, and the limiting groove is matched with the concrete-filled steel tubular column to be reinforced; a top of the bottom plate is provided with a lifting mechanism, a top of the lifting mechanism is in transmission connection with a lifting plate, and a shape of the lifting plate is matched with that of the bottom plate; a rotating mechanism is arranged in the lifting plate, and one side of a top surface of the lifting plate is provided with a driving mechanism, and the driving mechanism is in transmission connection with the rotating mechanism; and a top of the rotating mechanism is provided with two corresponding clamping mechanisms, and tops of the clamping mechanisms are provided with grinding mechanisms;

the lifting mechanism comprises two lifting motors, and the two lifting motors are fixedly connected to both sides of a top surface of the bottom plate; output ends of the lifting motors are fixedly connected with lifting screws, tops of the lifting screws penetrate through the lifting plate; the top surface of the lifting plate is respectively provided with two threaded holes and two guide holes, the two guide holes are symmetrically arranged about a center line of the lifting plate, and the two threaded holes are symmetrically arranged about the center line of the lifting plate, and outer walls of the lifting screws are connected with inner walls of the threaded holes through threads; and two sides of the top surface of the bottom plate are respectively fixedly connected with guide posts, tops of the two guide posts respectively penetrate through the two guide holes, and outer walls of the guide posts are in sliding contact with inner walls of the guide holes;

the rotating mechanism comprises an arc-shaped rod, and two opposite inner walls of the lifting plate are respectively provided with arc-shaped grooves matched with the arc-shaped rod; two ends of the arc-shaped rod are respectively in sliding contact with inner walls of the two arc-shaped grooves, and an outer wall of the arc-shaped rod is in transmission connection with the driving mechanism;

the driving mechanism comprises a driving motor, and the driving motor is fixedly connected to the top surface of the lifting plate; an output end of the driving motor is fixedly connected with a rotating disc, and an edge of a top surface of the rotating disc is fixedly connected with a rotating rod; a top outer wall of the rotating rod is rotatably connected with one end of a transmission rod through a bearing, and the other end of the transmission rod is provided with a transmission hole; an inner wall of the transmission hole is rotatably connected with one end of a hinge rod through a bearing, the outer wall of the arc-shaped rod is fixedly connected with a hinge seat, and the hinge rod is hinged with the hinge seat;

each clamping mechanism comprises a lifting cylinder, and the lifting cylinder is fixedly connected to one end of a top surface of the arc-shaped rod; an output end of the lifting cylinder is fixedly connected with a lifting rod, and a top surface of the lifting rod is fixedly connected with one end of a clamping plate, and a top surface of the other end of the clamping plate is fixedly connected with a clamping seat; a side surface of the clamping seat is fixedly connected with a butt joint cylinder; an output end of the butt joint cylinder passes through the clamping seat and is fixedly connected with one end of a butt joint rod, and the other end of the butt joint rod is fixedly connected with one end of the displacement rod; and a bottom surface of the displacement rod is in sliding contact with a top surface of the clamping plate, and the other end of the displacement rod is fixedly connected with each grinding mechanism;

each grinding mechanism comprises a semi-circular ring, and a top of the semi-circular ring is provided with an air blowing assembly; a top surface of the semi-circular ring is fixedly connected with a vibration motor, and an inner wall of the semi-circular ring is provided with a plurality of grinding assemblies at equal intervals, and a circumferential direction of the plurality of grinding assemblies coincides with a radius direction of the semi-circular ring;

each air blowing assembly comprises an air pump, and the air pump is fixedly connected to the top surface of the semi-circular ring, an output end of the air pump is communicated with one end of an air blowing pipe, the other end of the air blowing pipe is communicated with a nozzle, and an input end of the air pump is communicated with an outside atmosphere; and each grinding assembly comprises a shell, and the shell is fixedly connected to the outer wall of the semi-circular ring, and a grinding cylinder is fixedly connected to a side of the shell; an output end of the grinding cylinder penetrates through the shell and is fixedly connected to one end of a telescopic cylinder, the other end of the telescopic cylinder penetrates through the outer wall of the semi-circular ring, and a grinding motor is fixedly connected to an inner wall of the telescopic cylinder; an output end of the grinding motor is fixedly connected to one end of a grinding rod, and the other end of the grinding rod is fixedly connected with a grinding disc, and a sandpaper is detachably connected to a side of the grinding disc.

2. The method for reinforcing the concrete-filled steel tubular column with the outer concrete-filled steel tube according to claim 1, wherein in the step 2, four positioning steel bars are welded at equal intervals on the outer wall of the concrete-filled steel tubular column to be reinforced before welding the two semi-rectangular steel plates, and two oppositely arranged positioning steel bars are respectively abutted against middles of the two semi-rectangular steel plates, and the other two oppositely arranged positioning steel bars are respectively abutted against edges of the two semi-rectangular steel plates to realize a butt joint after positioning the two semi-rectangular steel plates.

3. The method for reinforcing the concrete-filled steel tubular column with the outer concrete-filled steel tube according to claim 1, wherein a circumferential direction of the concrete-filled steel tubular column to be reinforced set in the step 2 coincides with a center line of the rectangular steel tube.

4. The method for reinforcing the concrete-filled steel tubular column with the outer concrete-filled steel tube according to claim 1, wherein in the step 3, a bottom of the rectangular steel tube is provided with a slurry inlet hole, and a top of the rectangular steel tube is provided with a slurry outlet hole; the self-compacting concrete is introduced into the rectangular steel tube through the slurry inlet hole until the self-compacting concrete flows out of the slurry outlet hole, and then the slurry inlet hole and the slurry outlet hole are welded to complete the reinforcement.

* * * * *